US008015930B2

(12) United States Patent
Huang

(10) Patent No.: US 8,015,930 B2
(45) Date of Patent: Sep. 13, 2011

(54) QUICK AND EASY ASSEMBLY SHELVING UNIT AND METHOD FOR ASSEMBLING THE SAME

(76) Inventor: Su-Nu Huang, Dongguan (CN)

( * ) Notice: Subject to any disclaimer, the term of this patent is extended or adjusted under 35 U.S.C. 154(b) by 328 days.

(21) Appl. No.: 12/391,428

(22) Filed: Feb. 24, 2009

(65) Prior Publication Data

US 2010/0126952 A1 May 27, 2010

(30) Foreign Application Priority Data

Nov. 21, 2008 (CN) ..... 2008 2 0203824 U

(51) Int. Cl.
*A47B 91/00* (2006.01)

(52) U.S. Cl. ..... 108/193; 108/115; 108/184; 312/258

(58) Field of Classification Search ..... 108/115, 108/193, 184, 162, 176, 180, 187; 312/258, 312/262, 7.2; 211/149, 195; 16/267–268; 248/240, 240.3, 240.4, 241
See application file for complete search history.

(56) References Cited

U.S. PATENT DOCUMENTS

| | | | | |
|---|---|---|---|---|
| 5,308,157 | A * | 5/1994 | Dyer | 312/258 |
| 6,461,026 | B1 * | 10/2002 | Wang | 362/374 |
| 7,337,732 | B2 * | 3/2008 | Becker et al. | 108/193 |
| 2004/0046486 | A1 * | 3/2004 | Wicha | 312/7.2 |
| 2005/0067926 | A1 * | 3/2005 | Chiang | 312/258 |
| 2006/0288532 | A1 * | 12/2006 | Kim | 16/267 |
| 2008/0100188 | A1 * | 5/2008 | LeTourneau et al. | 312/258 |

* cited by examiner

*Primary Examiner* — Hanh V Tran
(74) *Attorney, Agent, or Firm* — Alan Kamrath; Kamrath & Associates PA

(57) ABSTRACT

A shelving unit includes a support frame and a plurality of support boards each detachably mounted on the support frame. The support frame includes a front support bracket, a first connecting bracket having a first end connected with a first end of the front support bracket, a second connecting bracket having a first end connected with a second end of the front support bracket, and a back board having a first end connected with a second end of the first connecting bracket and a second end connected with a second end of the second connecting bracket. Thus, the shelving unit can be assembled and disassembled without using tools, thereby facilitating a user assembling the shelving unit. In addition, the shelving unit can be folded into a smaller volume and reduces the cost of packaging, transportation and storage of the shelving unit.

14 Claims, 7 Drawing Sheets

QUICK AND EASY ASSEMBLY SHELVING UNIT AND METHOD FOR ASSEMBLING THE SAME

BACKGROUND OF THE INVENTION

1. Field of the Invention

The present invention relates to a quick and easy assembled shelving unit and, more particularly, to a quick and easy assembled shelving unit to display and store an electronic video or audio appliance, such as a television, video player, speaker and the like.

2. Description of the Related Art

A conventional shelving unit comprises a shelving unit body and a door pivotally mounted on the shelving unit body. The shelving unit body has an inner portion provided with a plurality of partitions to receive a plurality of electronic appliances, such as video players, sounds and the like. In addition, a television can be placed on the top of the shelving unit body. The shelving unit body consists of a plurality of connecting boards which are connected by a plurality of locking screws. However, the conventional shelving unit is either in a fully assembled construction or in a knock-down construction and has many shortcomings which dissuades consumers from buying it. For fully assembled construction, it cannot be folded so that the shelving unit has a larger overall volume and occupies a larger storage space. For knock-down construction, it requires tools and takes a considerable amount of time for assembly and disassembly. Therefore, conventional shelving unit causes inconvenience to a user in packaging, transportation and storage of the shelving unit and increasing the cost of fabrication.

BRIEF SUMMARY OF THE INVENTION

In accordance with the present invention, there is provided a shelving unit, comprising a support frame. The support frame includes a front support bracket, a first connecting bracket having a first end pivotally connected with a first end of the front support bracket, a second connecting bracket having a first end pivotally connected with a second end of the front support bracket, and a back board having a first end connected with a second end of the first connecting bracket and a second end connected with a second end of the second connecting bracket.

The primary objective of the present invention is to provide a shelving unit that is foldable easily and quickly without using tools while transporting or when not in use.

Another objective of the present invention is to provide a shelving unit, wherein the support frame of the shelving unit can be folded to have a smaller volume to decrease the cost of packaging, transportation and storage of the shelving unit.

A further objective of the present invention is to provide a shelving unit, wherein the shelving unit can be assembled and disassembled easily and quickly without using tools, thereby greatly facilitating a user on saving a considerable amount of time to assemble and disassemble the shelving unit.

A further objective of the present invention is to provide a shelving unit, wherein the shelving unit can be folded when not in use to save the space of storage largely, thereby facilitating the user storing and moving the shelving unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
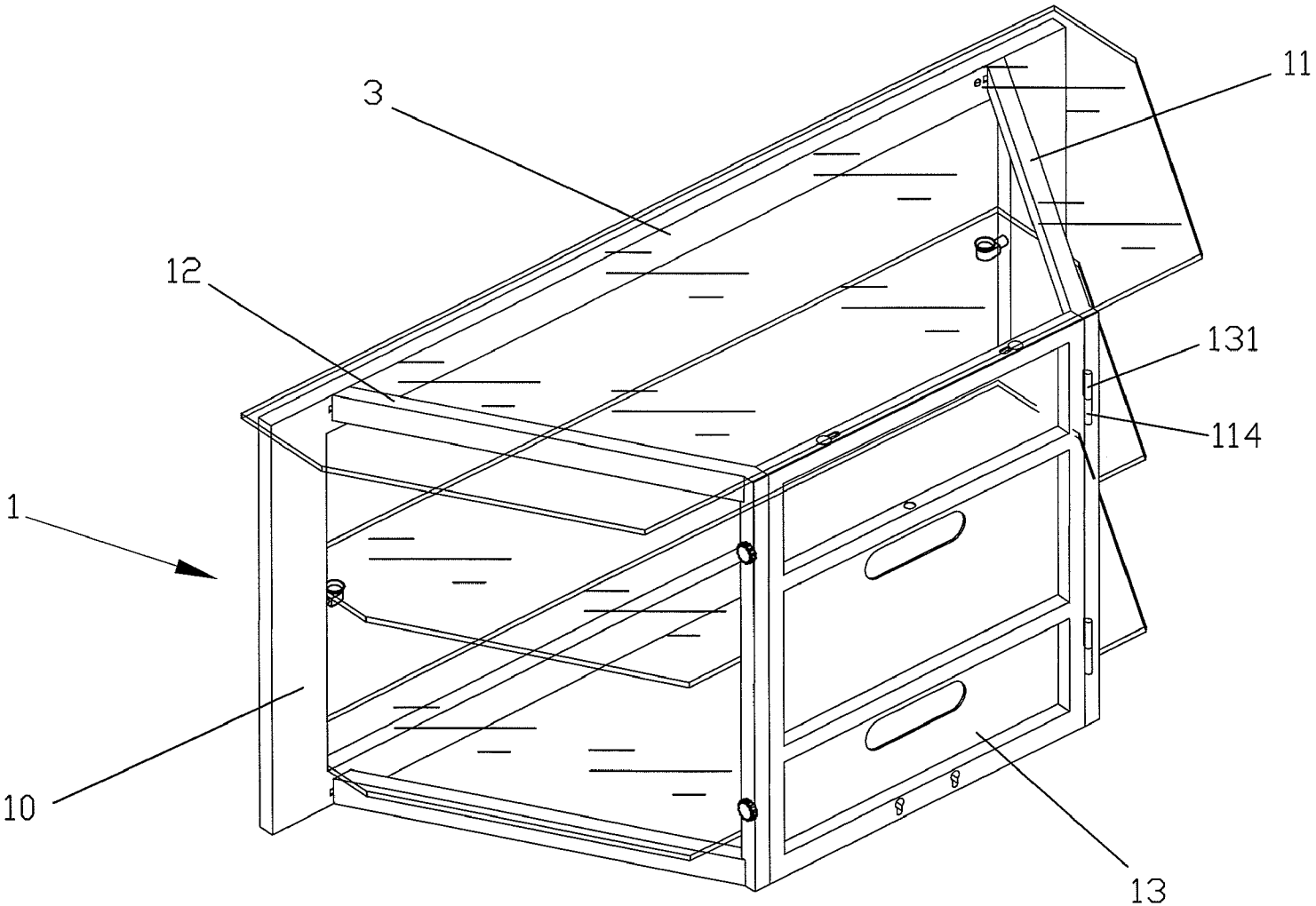
FIG. 1 is a perspective view of a shelving unit in accordance with the preferred embodiment of the present invention.
Figure 2:
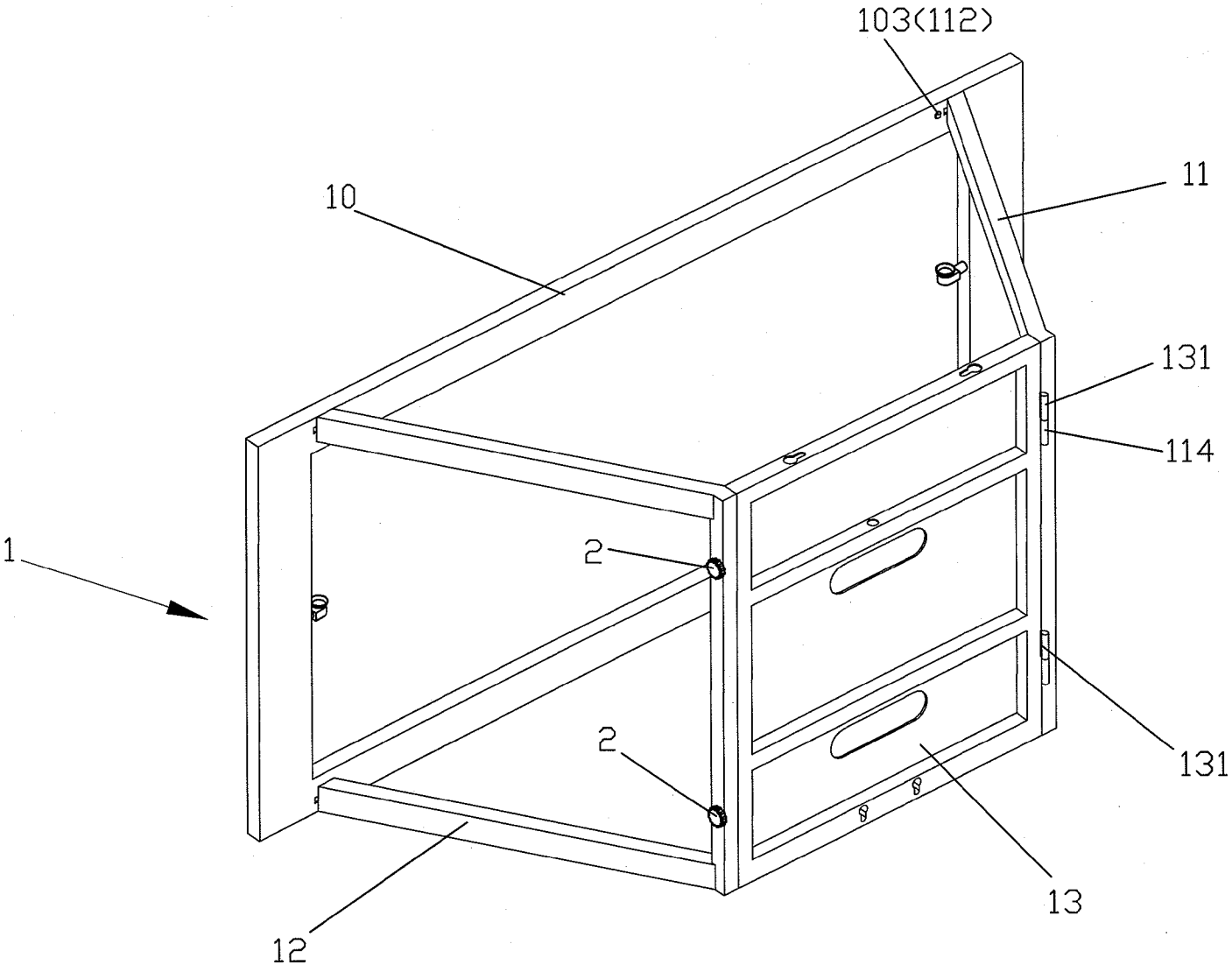
FIG. 2 is a perspective view of a support frame of the shelving unit as shown in FIG. 1.
Figure 3:
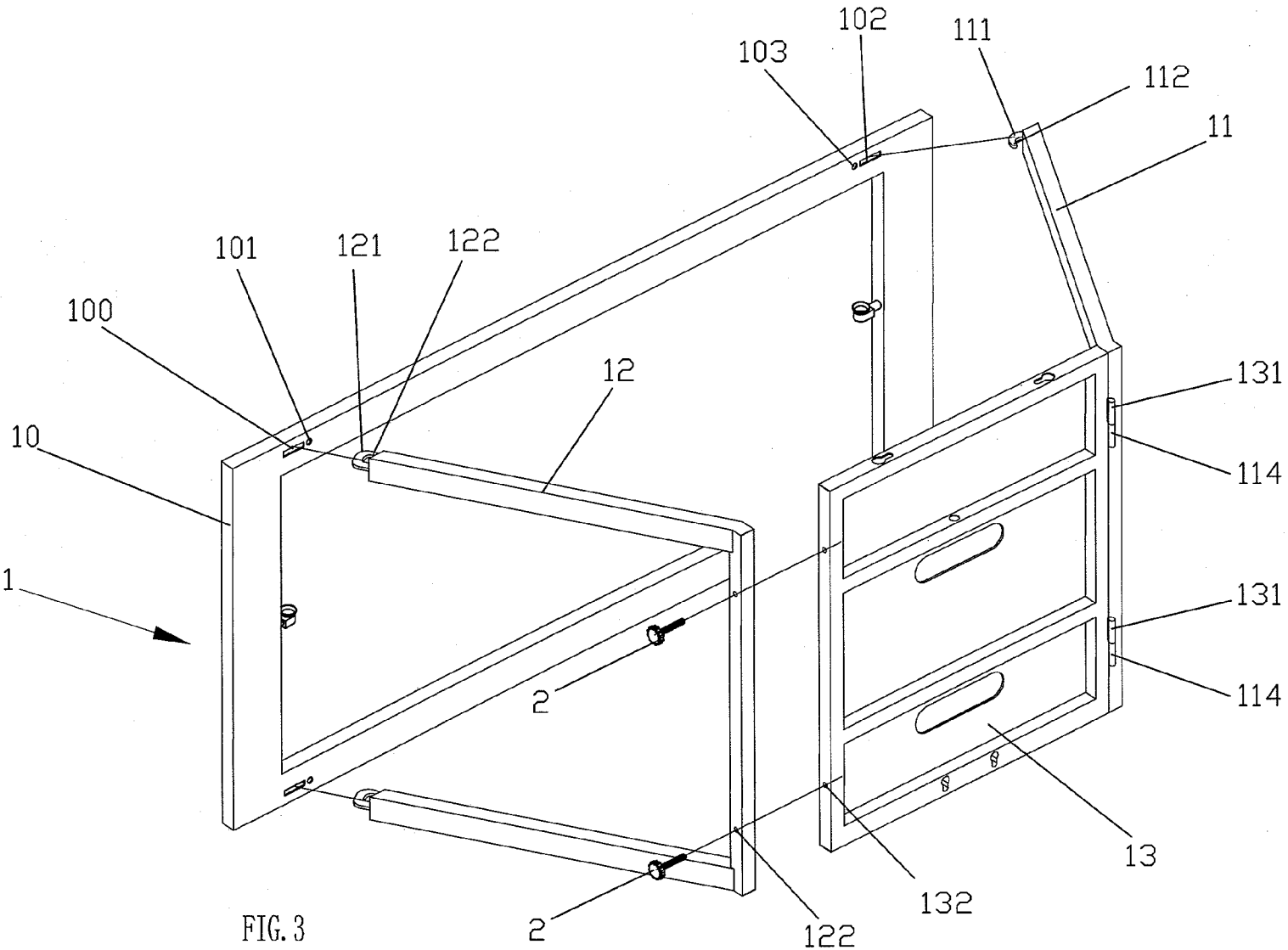
FIG. 3 is an exploded perspective view of the support frame of the shelving unit as shown in FIG. 2.
Figure 4:
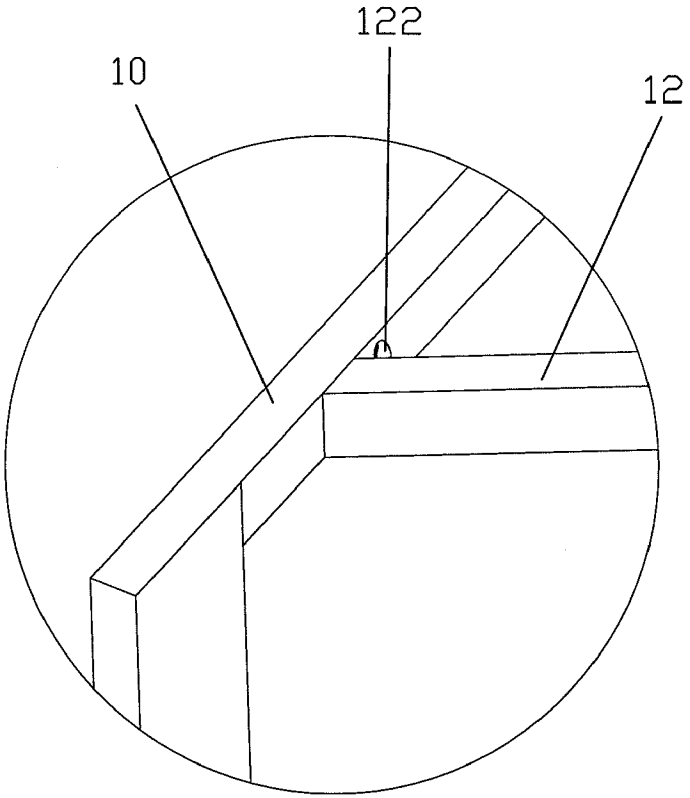
FIG. 4 is a locally enlarged view of the support frame of the shelving unit as shown in FIG. 2.
Figure 5:
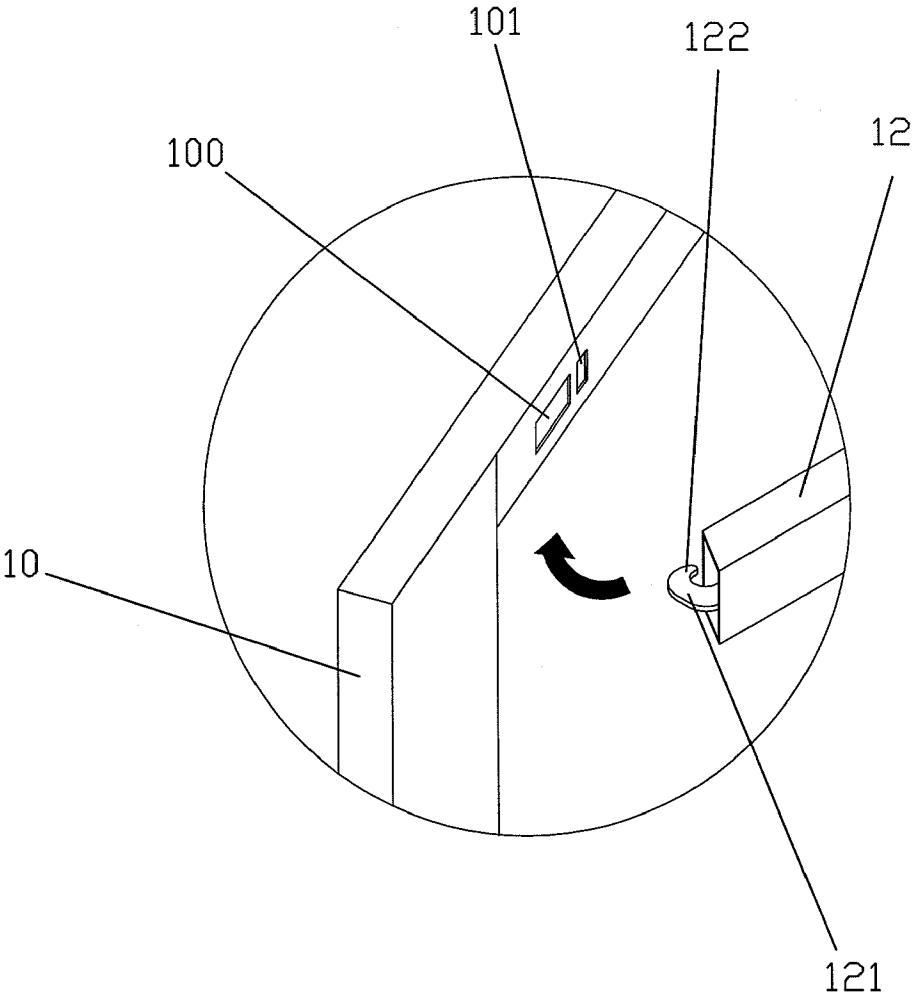
FIG. 5 is an exploded perspective view of the support frame of the shelving unit as shown in FIG. 4.

Referring to the drawings and initially to FIGS. 1-5, a shelving unit in accordance with the preferred embodiment of the present invention comprises a support frame 1, and a plurality of support boards 3 each detachably mounted on the support frame 1.

The support frame 1 includes a front support bracket 10, a first connecting bracket 11 having a first end pivotally connected with a first end of the front support bracket 10, a second connecting bracket 12 having a first end pivotally connected with a second end of the front support bracket 10, and a back board 13 having a first end connected with a second end of the first connecting bracket 11 and a second end connected with a second end of the second connecting bracket 12.

The front support bracket 10 is a rectangular hollow body. The first end of the front support bracket 10 is provided with two opposite guide slots 102. The first end of the front support bracket 10 is further provided with two opposite locking holes 103 each located beside a respective one of the two guide slots 102. The second end of the front support bracket 10 is provided with two opposite guide grooves 100. The second end of the front support bracket 10 is further provided with two opposite locking bores 101 each located beside a respective one of the two guide grooves 100.

The first connecting bracket 11 has a substantially U-shaped profile and has an opening directed toward the front support bracket 10. The first end of the first connecting bracket 11 is provided with two opposite locking hooks 111 each extending through and pivotally mounted in a respective one of the two guide slots 102 of the front support bracket 10 so that the first end of the first connecting bracket 11 is pivotally mounted on the first end of the front support bracket 10. Each of the two locking hooks 111 of the first connecting bracket 11 has a bent distal end provided with a locking portion 112 detachably locked in a respective one of the two locking holes 103 of the front support bracket 10. The second end of the first connecting bracket 11 is provided with two opposite first hinges 114.

The second connecting bracket 12 is located opposite to the first connecting bracket 11. The second connecting bracket 12 and the first connecting bracket 11 are located between the front support bracket 10 and the back board 13. The second connecting bracket 12 has a substantially U-shaped profile and has an opening directed toward the front support bracket 10. The first end of the second connecting bracket 12 is provided with two opposite locking hooks 121 each extending through and pivotally mounted in a respective one of the two guide grooves 100 of the front support bracket 10 so that the first end of the second connecting bracket 12 is pivotally mounted on the second end of the front support bracket 10. Each of the two locking hooks 121 of the second connecting bracket 12 has a bent distal end provided with a locking portion 122 detachably locked in a respective one of the two locking bores 101 of the front support bracket 10. The second end of the second connecting bracket 12 is provided with two opposite through holes 122.

The back board 13 is located opposite to the front support bracket 10. The back board 13 and the front support bracket 10 are located between the first connecting bracket 11 and the second connecting bracket 12. The first end of the back board 13 is pivotally connected with the second end of the first connecting bracket 11 and is provided with two opposite second hinges 131 each pivotally connected with a respective one of the two first hinges 114. The second end of the back board 13 is detachably connected with the second end of the second connecting bracket 12 and is provided with two opposite screw bores 132.

The support frame 1 further includes two fastening bolts 2 each extending through the second end of the second connecting bracket 12 and each screwed into the second end of the back board 13 to detachably lock the second end of the second connecting bracket 12 onto the second end of the back board 13. Each of the fastening bolts 2 is rotatably mounted on the second end of the second connecting bracket 12. Each of the fastening bolts 2 extends through a respective one of the two through holes 122 of the second connecting bracket 12 and is screwed into a respective one of the two screw bores 132 of the back board 13 to detachably lock the second end of the second connecting bracket 12 onto the second end of the back board 13.

The support boards 3 are located between and supported by the front support bracket 10, the back board 13, the first connecting bracket 11 and the second connecting bracket 12. Each of the support boards 3 is used to receive and store an electric or electronic appliance, such as a television, video player, sound and the like.

Figure 6:
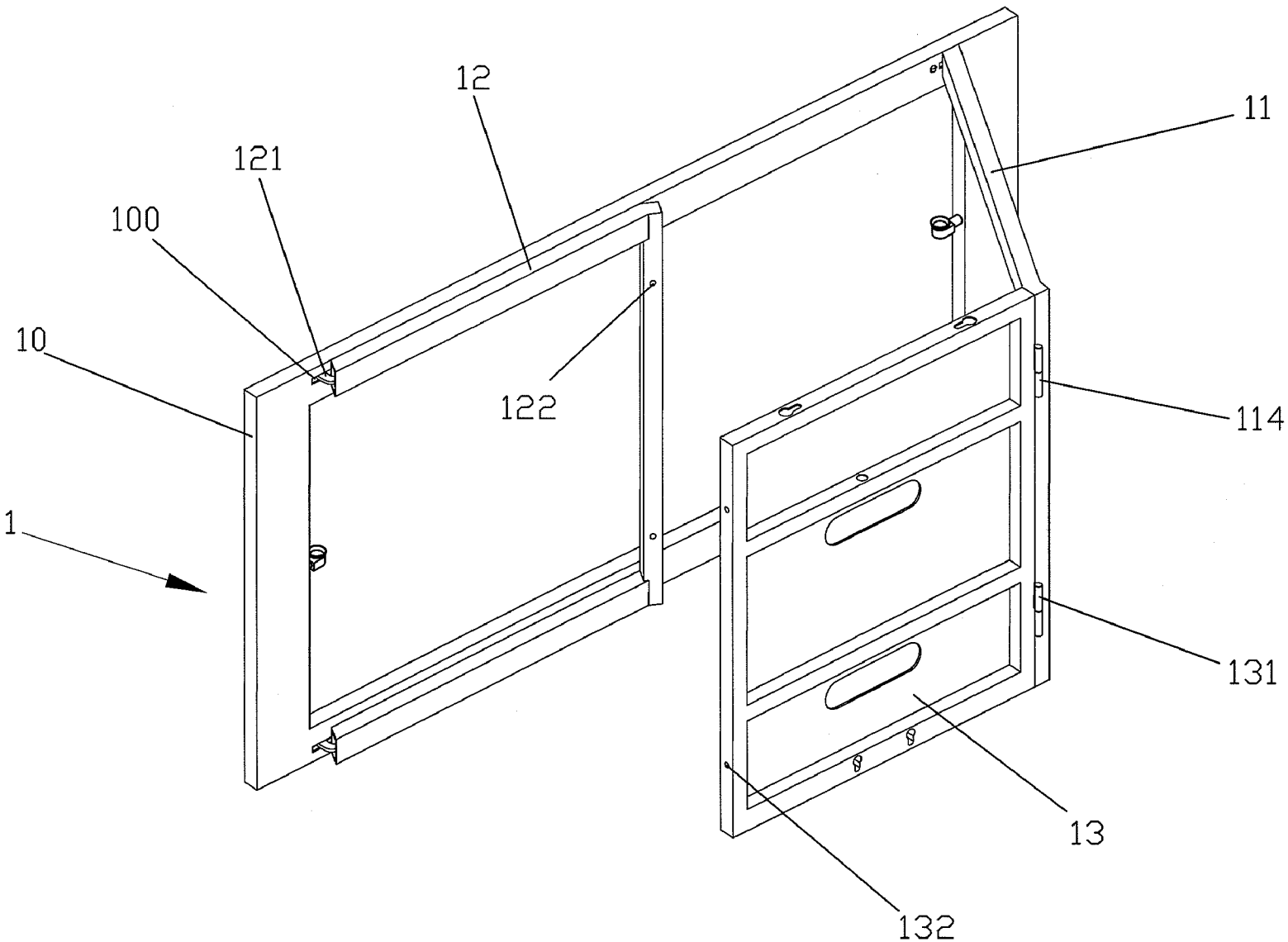
FIG. 6 is a folded view of the support frame of the shelving unit as shown in FIG. 2.
Figure 7:
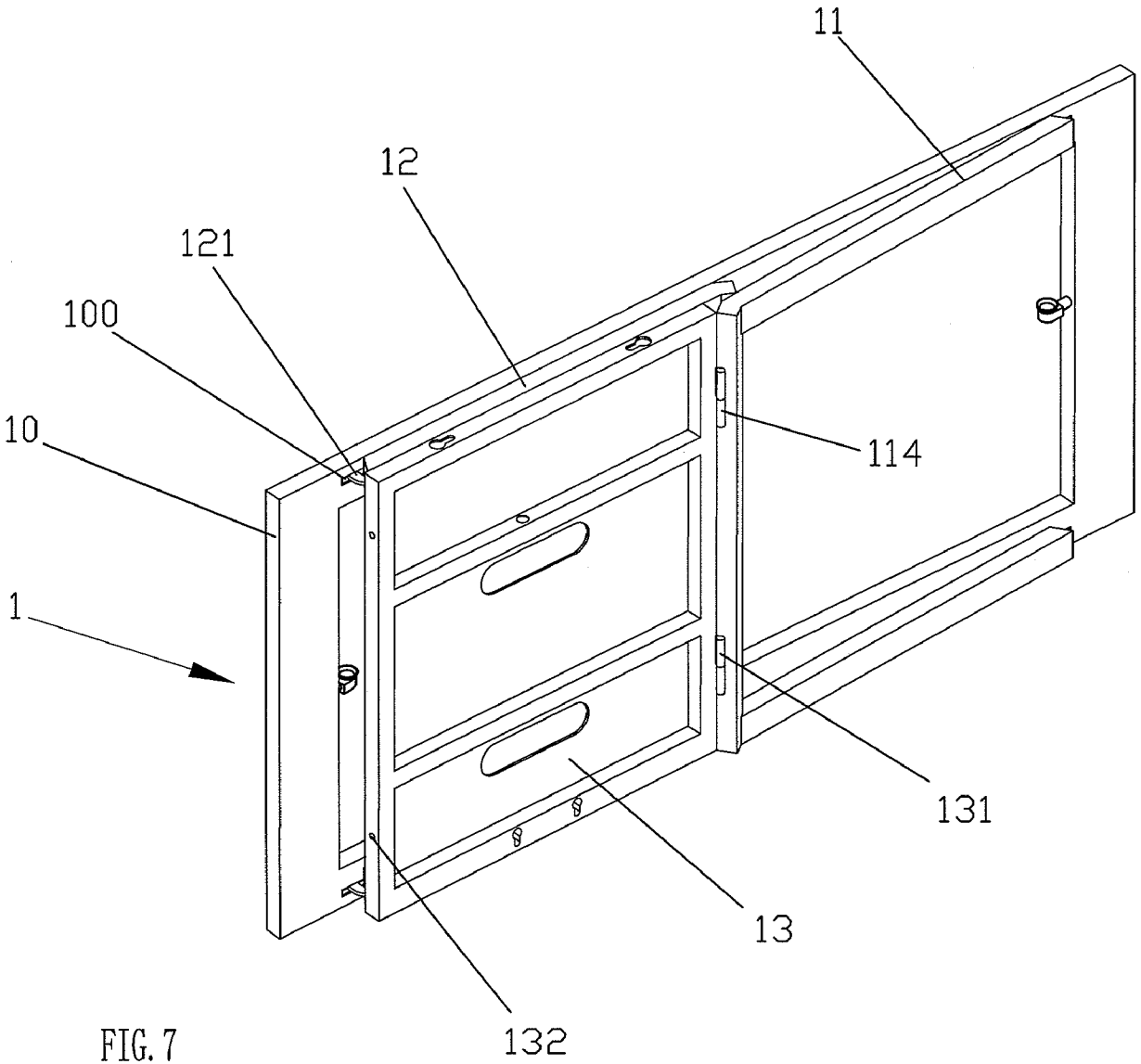
FIG. 7 is a folded view of the support frame of the shelving unit as shown in FIG. 6.

In operation, referring to FIGS. 6 and 7 with reference to FIGS. 1-5, when a user wishes to fold the support frame 1 of the shelving unit, each of the fastening bolts 2 is unscrewed from the respective screw bore 132 of the back board 13 and is removed from the respective through hole 122 of the second connecting bracket 12 to detach the second end of the second connecting bracket 12 from the second end of the back board 13. Then, after the second end of the second connecting bracket 12 is removed from the second end of the back board 13, the first end of the second connecting bracket 12 is pivotable relative to the second end of the front support bracket 10 so that the second connecting bracket 12 is movable to abut the front support bracket 10 as shown in FIG. 6. Then, the first end of the first connecting bracket 11 is pivotable relative the first end of the front support bracket 10 so that the first connecting bracket 11 and the back board 13 are movable to abut the front support bracket 10 and the second connecting bracket 12 as shown in FIG. 7 so as to fold the support frame 1 of the shelving unit.

Accordingly, the support frame 1 of the shelving unit can be folded to have a smaller volume so as to decrease the cost of packaging, transportation and storage of the shelving unit. In addition, the shelving unit can be assembled and disassembled easily and quickly without using tools, thereby greatly facilitating a user on saving considerable amount of time to assemble and disassemble the shelving unit. Further, the shelving unit can be folded when not in use to save the space of storage largely, thereby facilitating the user storing and moving the shelving unit.

Figure 8:
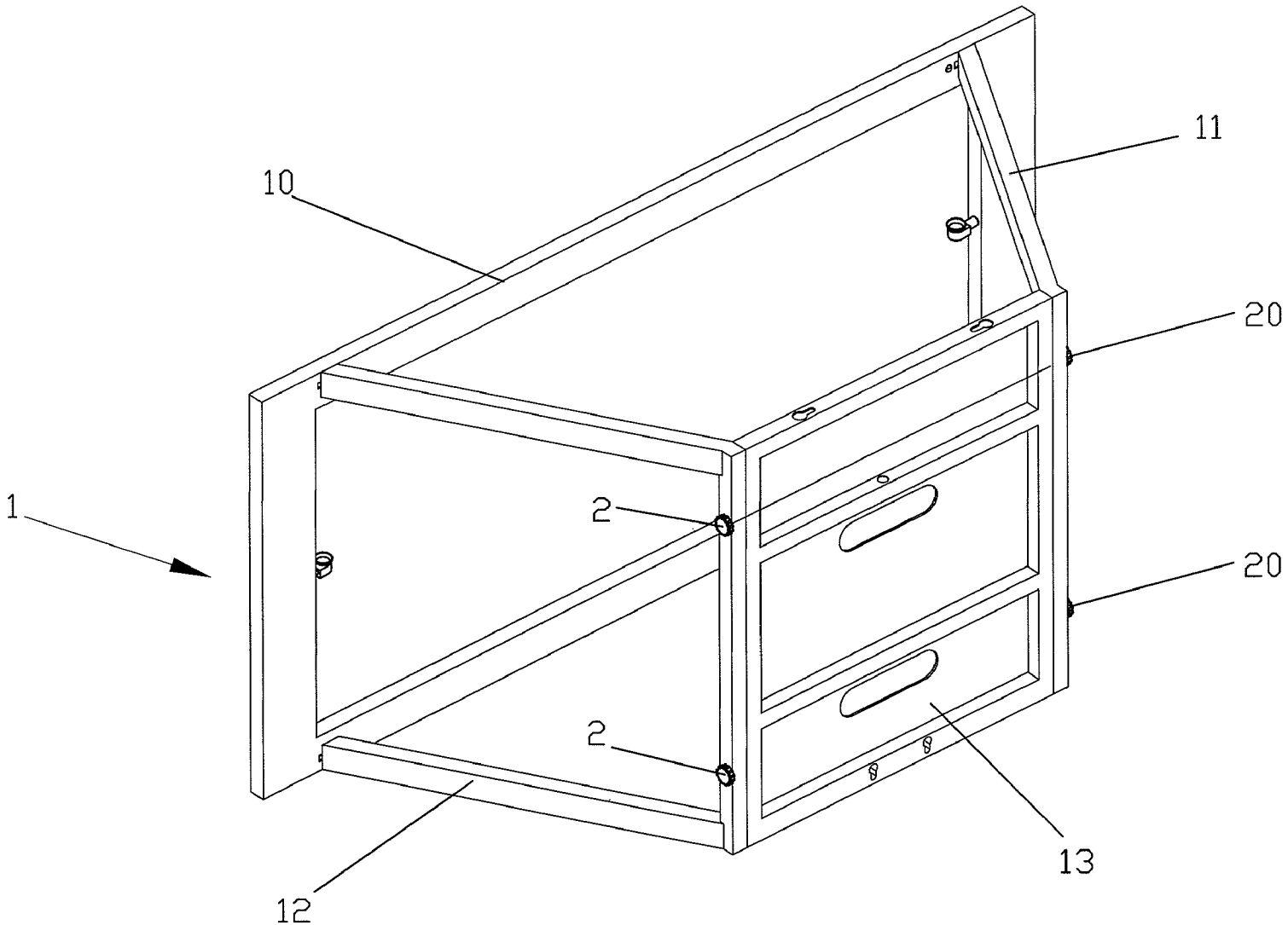
FIG. 8 is a perspective view of a support frame of the shelving unit in accordance with another preferred embodiment of the present invention.

As shown in FIG. 8, the support frame 1 further includes two locking bolts 20 each extending through the second end of the first connecting bracket 11 and each screwed into the first end of the back board 13 to detachably lock the second end of the first connecting bracket 11 onto the first end of the back board 13. Thus, the first end of the back board 13 is detachably connected with the second end of the first connecting bracket 11.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shelving unit, comprising:

a support frame including:

a front support bracket;

a first connecting bracket having a first end pivotally connected with a first end of the front support bracket;

a second connecting bracket having a first end pivotally connected with a second end of the front support bracket;

a back board having a first end connected with a second end of the first connecting bracket and a second end connected with a second end of the second connecting bracket;

wherein the first end of the front support bracket is provided with two opposite guide slots;

the first end of the first connecting bracket is provided with two opposite locking hooks each extending through and pivotally mounted in a respective one of the two guide slots of the front support bracket so that the first end of the first connecting bracket is pivotally mounted on the first end of the front support bracket;

the first end of the front support bracket is further provided with two opposite locking holes each located beside a respective one of the two guide slots;

each of the two locking hooks of the first connecting bracket has a bent distal end provided with a locking portion detachably locked in a respective one of the two locking holes of the front support bracket;

the second end of the front support bracket is provided with two opposite guide grooves;

the first end of the second connecting bracket is provided with two opposite locking hooks each extending through and pivotally mounted in a respective one of the two guide grooves of the front support bracket so that the first end of the second connecting bracket is pivotally mounted on the second end of the front support bracket;

the second end of the front support bracket is further provided with two opposite locking bores each located beside a respective one of the two guide grooves;

each of the two locking hooks of the second connecting bracket has a bent distal end provided with a locking portion detachably locked in a respective one of the two locking bores of the front support bracket.

2. The shelving unit of claim 1, wherein the first end of the back board is pivotally connected with the second end of the first connecting bracket.

3. The shelving unit of claim 2, wherein the second end of the first connecting bracket is provided with two opposite first hinges;

the first end of the back board is provided with two opposite second hinges each pivotally connected with a respective one of the two first hinges.

4. The shelving unit of claim 1, wherein the second end of the back board is detachably connected with the second end of the second connecting bracket.

5. The shelving unit of claim 4, wherein the support frame further includes two fastening bolts each extending through the second end of the second connecting bracket and each screwed into the second end of the back board to detachably lock the second end of the second connecting bracket onto the second end of the back board.

6. The shelving unit of claim 5, wherein the second end of the second connecting bracket is provided with two opposite through holes;

the second end of the back board is provided with two opposite screw bores;

each of the fastening bolts extends through a respective one of the two through holes of the second connecting bracket and is screwed into a respective one of the two screw bores of the back board to detachably lock the second end of the second connecting bracket onto the second end of the back board.

7. The shelving unit of claim 5, wherein each of the fastening bolts is rotatably mounted on the second end of the second connecting bracket.

8. The shelving unit of claim 4, wherein after the second end of the second connecting bracket is removed from the second end of the back board, the first end of the second connecting bracket is pivotable relative to the second end of the front support bracket, and the second connecting bracket is movable to abut the front support bracket.

9. The shelving unit of claim 1, wherein after the second end of the second connecting bracket is removed from the second end of the back board, the first end of the first connecting bracket is pivotable relative the first end of the front support bracket, and the first connecting bracket and the back board are movable to abut the front support bracket and the second connecting bracket.

10. The shelving unit of claim 1, wherein the first end of the back board is detachably connected with the second end of the first connecting bracket.

11. The shelving unit of claim 10, wherein the support frame further includes two locking bolts each extending through the second end of the first connecting bracket and each screwed into the first end of the back board to detachably lock the second end of the first connecting bracket onto the first end of the back board.

12. The shelving unit of claim 1, wherein the second connecting bracket is located opposite to the first connecting bracket;

the second connecting bracket and the first connecting bracket are located between the front support bracket and the back board;

the back board is located opposite to the front support bracket;

the back board and the front support bracket are located between the first connecting bracket and the second connecting bracket.

13. The shelving unit of claim 12, wherein the front support bracket is a rectangular hollow body;

the first connecting bracket has a substantially U-shaped profile and has an opening directed toward the front support bracket;

the second connecting bracket has a substantially U-shaped profile and has an opening directed toward the front support bracket.

14. The shelving unit of claim 12, wherein the shelving unit further comprises a plurality of support boards each detachably mounted on the support frame;

the support boards are located between and supported by the front support bracket, the back board, the first connecting bracket and the second connecting bracket.

* * * * *